US005275428A

United States Patent [19]

Bejean et al.

[11] Patent Number: 5,275,428

[45] Date of Patent: Jan. 4, 1994

[54] CROSS-COUNTRY SKI FOR SKATING

[75] Inventors: Alain Bejean, Mures; Yvan Thevenin, La Balme de Sillingy, both of France

[73] Assignee: Salomon S.A., Annecy Cedex, France

[21] Appl. No.: 643,488

[22] Filed: Jan. 22, 1991

[30] Foreign Application Priority Data

Jan. 29, 1990 [FR] France ..... 90 01311

[51] Int. Cl.[5] ..... A63C 5/07

[52] U.S. Cl. ..... 280/602; 280/609

[58] Field of Search ..... 280/601, 602, 609, 610

[56] References Cited

U.S. PATENT DOCUMENTS

| | | | |
|---|---|---|---|
| 3,398,968 | 8/1968 | Mutzhas | 280/602 |
| 4,071,264 | 1/1978 | Legrand et al. | 280/602 X |
| 4,300,786 | 11/1981 | Alley | 280/602 |
| 4,577,886 | 3/1986 | Chernega | 280/602 |
| 4,652,006 | 3/1987 | Desoutter | 280/604 |
| 4,740,009 | 4/1988 | Hoelzl | 280/602 |

FOREIGN PATENT DOCUMENTS

| | | | |
|---|---|---|---|
| 232434 | 1/1986 | Fed. Rep. of Germany | 280/602 |
| 2546764 | 12/1984 | France . | |
| 0622430 | 4/1981 | Switzerland . | |

*Primary Examiner*—Margaret A. Focarino
*Assistant Examiner*—Michael Mar
*Attorney, Agent, or Firm*—Sandler, Greenblum & Bernstein

[57] ABSTRACT

The cross-country ski according to the invention is characterized by a relatively regular curvature of the lower surface of the ski, i.e., a curvature such that the modules of variation of slope of the lower surface of the ski is less than $9.10^4$ $cm^{-1}$ when the ski is at rest. Simultaneously, the front zone of the ski has a relatively high rigidity. Likewise, the rear zone can be relatively rigid. Preferably, the lateral surfaces of the ski are hollowed. Such a ski structure is particularly well adapted to obtain a good gripping of the edges, a good sliding on the edges, and a good sliding in direct tracks.

23 Claims, 4 Drawing Sheets

PRIOR ART

CROSS-COUNTRY SKI FOR SKATING

BACKGROUND OF THE INVENTION

1. Field of the Invention

The present invention relates to cross-country skis utilized for moving on snow using racing techniques on cross-country tracks, while going up, going down and on uneven terrain.

2. Description of Background and Relevant Information

Cross-country skis generally comprise a central portion which is slightly bent between a front contact line and a rear contact line, with a front end zone curved upwardly to form a spatula in front of the front contact line, and with a rear end zone generally slightly curved upwardly, at the rear of the rear contact line.

When the cross-country ski is positional on a plane, through its lower slide surface, at rest, it rests on the plane through two transverse lines, referred to as front and rear contact lines. Between the two front and rear contact lines, the slightly bent central portion detaches from the support plane, from the front contact line, the distance increases progressively between the support plane and the lower slide surface of the ski, until reaching a maximum in the central zone of the ski, then this distance diminishes progressively until reaching the rear contact line.

For many years, the traditional racing technique for cross-country skiing, for progression on flat ground and when going uphill, has comprised alternating steps. According to this technique, the two skis remain parallel in the direction of movement, the skier alternatively pushing on one ski to make the other slide. For the support to be efficacious, so as to give a good impulsion towards the front, one has always sought to give to the ski a particular structure in which the slight bend of the central zone of the ski has a relatively pronounced elbow in its center: from the front line of contact, the ski resting on a flat surface, the traditional slight bend is such that the distance increases progressively along a slope which diminishes slightly until reaching the central zone of the ski. In the central zone of the ski, the slope decreases very rapidly, to reverse, and then diminishes slightly when one moves in the direction of the rear contact line, until reaching this rear contact line. In the central zone of traditional skis, the modulus of variation of slope is relatively constant and is on the order of about $10^{-3}$ to about $2.10^{-3}cm^{-1}$. By virtue of this strong variation in slope, such a traditional slight bend constitutes, adjacent to the central zone of the ski, a portion which is slightly lifted from the support plane when the skier is simply resting on his skis. To apply this central zone against the support plane, it is necessary to give to the ski an impulse from top to bottom with a relatively substantially force.

Such a slight bend configuration, having a pronounced elbow, makes it possible, in the traditional technique of alternating steps, to reserve a central zone of the ski having good qualities of adherence on the snow. Thus, in the absence of impulse from top to bottom on the ski, the central adhering zone can rest slightly lifted from the snow, and not oppose sliding of the ski. On the other hand, by giving an impulse from top to bottom, the skier can apply the central adhering zone on the snow, thus taking advantage of this adherence for support and to progress forwardly.

To obtain good sliding qualities despite the presence of the central elbow, it has been necessary, in conventional cross-country skis, to make the ends of the ski particularly flexible. One can characterize this flexibility by subjecting the ends of the ski to flexions under weight. Thus, when a length of 570 mm. of ski of a traditional cross-country ski, beginning at the front line of contact, is retained at its ends by free support and is subjected at its center to a substantially perpendicular force of 200 newtons, the elastic displacement of its central zone is about 200–350 mm.

Likewise, if a similar length of ski, adjacent the rear contact line is subjected to a similar test, the displacement of the central zone is approximately 100–250 mm.

For these flexibility tests, the contact lines are determined in a particular manner as will be seen below, so as to obtain a good reproduceability of the measures.

More recently, the technique of cross-country skiing has evolved, and it is now oriented towards movement by means of a skating step. In this technique, the skier places his skis along slightly diverging directions with respect to the direction of movement, and alternatively pushes on one ski and the other: at each step, one of the skis slides substantially flat while the other serves as a support and is for this reason inclined to make the interior edge of the ski bite.

However, it appears that the conventional cross-country skis are not adapted for such a skating technique.

In particular, the great flexibility of the front and rear ends of a traditional ski do not make it possible to take advantage of a good support on the interior edge to give a skating step impulse. And if one increases the rigidity of the ski, one obtains a cross-country ski whose sliding qualities are quite insufficient and are no longer compatible with the anticipated utilization.

SUMMARY OF THE INVENTION

A particular object of the present invention to provide a new cross-country ski which is particularly well adapted for the new techniques of movement using skating steps.

The cross-country ski according to the invention provides the best compromise between the qualities of flat sliding, the qualities of sliding on the interior edge during impulse using skating steps, and the gripping qualities on the interior edge for impulse using skating steps.

To achieve these objects as well as others, a cross-country ski according to the present invention is distinguished in particular from known skis by the fact that, in the central zone of the slightly bent or acuate central portion, the modules of variation of slope is less than $9.10^{-4}\ cm^{-1}$ when the ski is at rest.

The modulus of variation of slope can preferably be less than the same limiting value of $9.70^{-4}\ cm^{-1}$ in the entire central portion of the ski.

According to one embodiment, the modulus of variation of slope is substantially constant in the central portion of the ski, between the inflexion lines.

In the zone of the central portion positioned adjacent to the front contact line, the ski is relatively rigid, its rigidity being such that, when a length of 570 mm. of ski beginning at the front contact line, is retained at its ends by free supports and is subject at its center to a substantially perpendicular force of 200 newtons, the elastic displacement of its central zone is less than about 200 tenths of mm., i.e., 20 millimeters. By convention, to obtain a good reproduceability of measurement, the longitudinal position of the front contact line is measured by introducing a cubic wedge of 1 $cm^3$ under the spatula, and corresponds to a point at a distance of 9.5 cm. from the center of the wedge in the direction of the middle of the ski. This combination of characteristic provides both good qualities of flat sliding, and good gripping qualities on the edge which is supporting during the skating step, the slide on the edge being likewise excellent.

According to one embodiment of the invention, in the central zone positioned adjacent to the rear contact line, the ski is likewise relatively rigid, its rigidity being such that, when a length of about 570 mm. of ski is subjected at its center to a substantially perpendicular force of 200 newtons, the elastic displacement of its central zone is less than approximately 100 tenths of mm. By convention, to obtain a good reproduceability of measurement, the rear contact line is generally measured at 5 cm. from the rear end of the ski.

Good results have been obtained with a cross-country in which the rigidity of the front zone of the ski is such that the displacement of the central zone is approximately 150 tenth of mm., i.e., 15 millimeters while the rigidity of the rear zone of the ski is such that the elastic displacement of the central zone is 90 mm.

One obtains a further improved gripping quality on the edge by providing further, on such a cross-country ski of the invention, a lateral interior surface which is hollowed out such that the maximum distance between the lateral surface and the chord connecting the end zones of the lateral surface is greater than about 1.25 mm. Good results are obtained for a maximum distance of about 2.5 mm.

BRIEF DESCRIPTION OF THE DRAWINGS

Other objects, characteristics, and advantages of the present invention will become clear from the description of several embodiments which follow, given with reference to the annexed drawings, by way of non-limiting examples only, in which.

DESCRIPTION OF PREFERRED EMBODIMENTS

Figure 1:
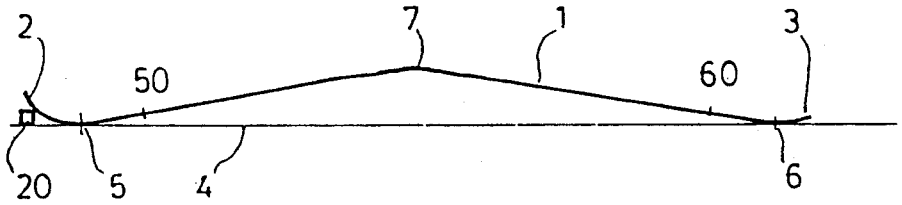
PRIOR ART Fig. 1
FIGS. 1 and 2 illustrate the profile of traditional ski resting flat on a support plane, respectively at rest and subjected to a central support force.
Figure 2:
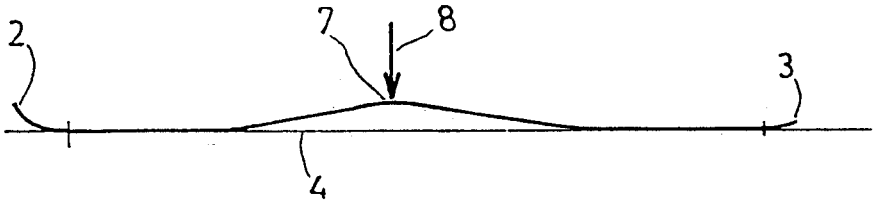
PRIOR ART Fig. 2

As shown in FIGS. 1 and 2, a cross-country ski generally comprises a slightly bent central portion 1, connected to a front end zone 2, which is curved upwardly in the form of a spatula, and a rear end zone 3 generally lifted upwardly in the form of the heel. When the ski rests on a support plane 4 at rest, it rests along a front contact line 5 and a rear contact line 6 defining the central portion 1.

The median zone of the central portion 1 has a concavity which is turned downwardly, and it is respectively connected, through a front inflexion line 50 and a rear inflexion line 60, to a front zone and a rear zone of the central portion 1 whose concavities are turned upwardly. Generally, the inflexion lines 50 and 60 are spaced not far from the respective contact lines 5 and 6.

In a traditional ski, as shown in FIGS. 1 and 2, the central zone 7 of the slightly bent central portion 1 has a relatively pronounced elbow. In this manner, when the user is supported by the ski, his weight constitutes a force 8 applied from top to bottom on the central zone 7 but, through the presence of the elbow of the central zone 7, the central zone does not touch the plane 4, as shown in FIG. 2. To make the central zone 7 touch the plane 4, the user must apply a supplemental impulse. By providing such a central zone 7 having gripping qualities on the snow, either by a particular paint or by the presence of a casing, the user can, through a supplemental impulse, take advantage of the adherence qualities of the central zone 7. On the other hand, in the position of normal sliding, the weight of the user does not press the central zone 7 on the snow, and does not brake the ski.

Figure 3:
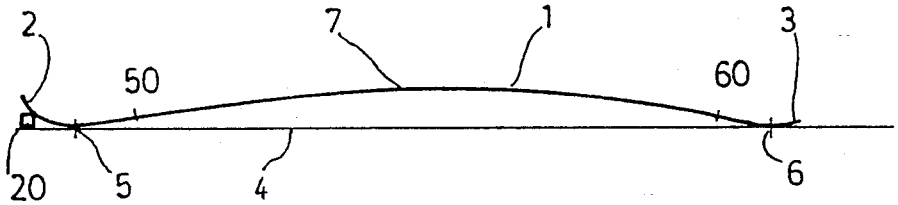
FIGS. 3 and 4 illustrate the profile of a ski according to the present invention under the same conditions, ski at rest on a plane, ski on a plane and subjected to a central support force.
Figure 4:
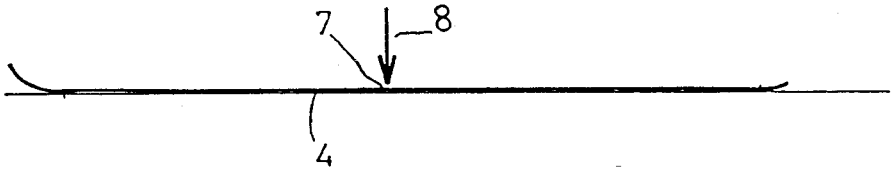

On the other hand, as shown in FIG. 3, a ski according to the present invention comprises a central portion 1 whose central zone 7 does not comprise an elbow. Otherwise stated, the arcuate or sightly bent central portion 1 has a variation of slope whose value is relatively small over the entire length of the central portion 1 of the ski, this value being preferably less than about $9.10^{-4}\ cm^{-1}$, when the ski is at rest. In this manner, as shown in FIG. 4, when the user is resting on the ski, the force 8 applied to the central zone 7 suffices to press the ski substantially along its entire lower surface on the plane 4. Thus, the slight bend of central portion 1 of the ski according to the present invention has a low flattening force, while the traditional cross-country ski requires a very substantial force to flatten the ski, by virtue of the presence of the elbow of the central zone 7.

Figures 7, 8, 9:
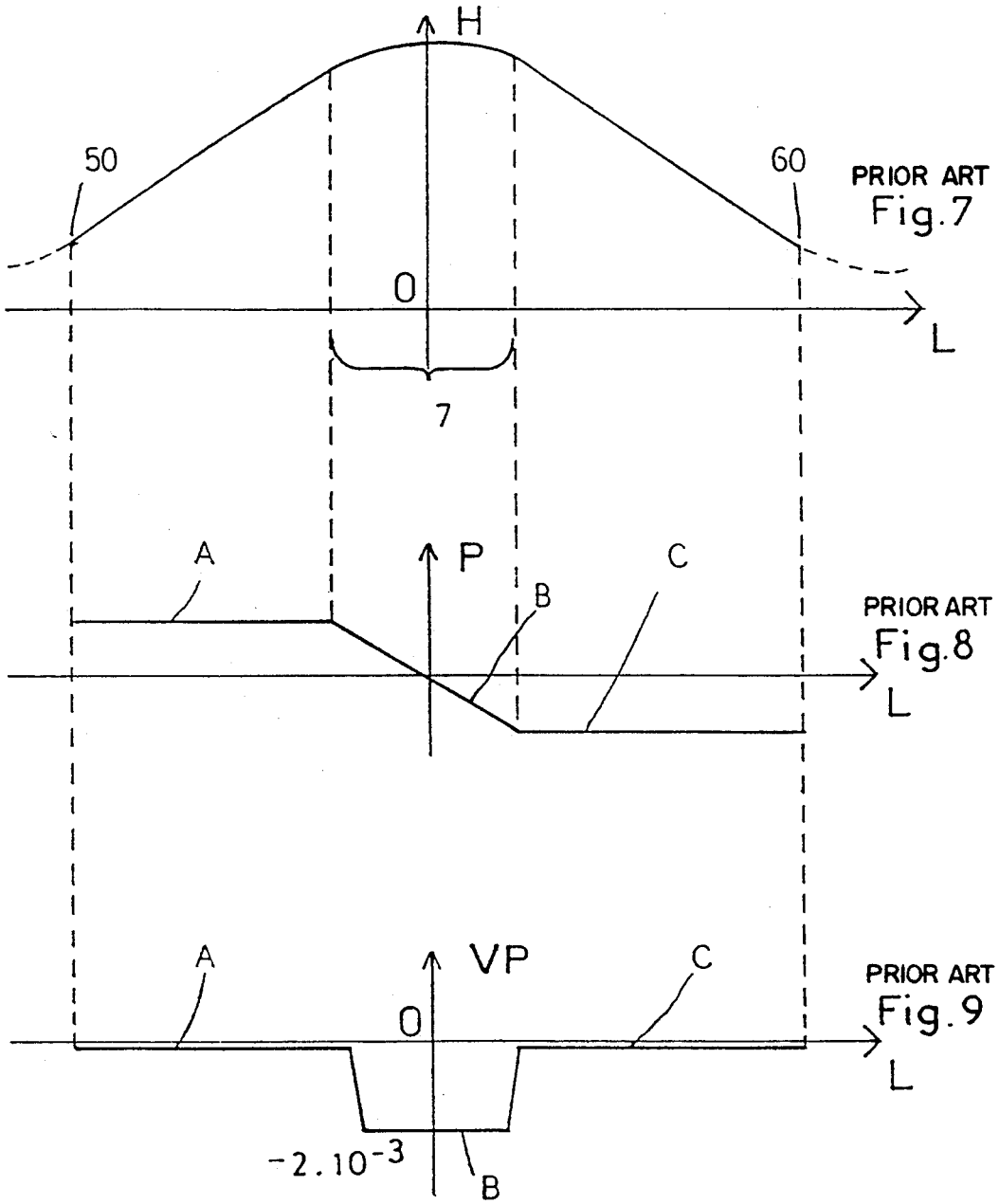
Fig.7 PRIOR ART
Fig.8 PRIOR ART
FIG. 7 illustrates on a larger scale, the curve describing the profile of a traditional ski at rest, giving a distance between the lower sliding surface of the ski and a support plane as a function of the longitudinal position of the ski which is being considered.
FIG. 8 illustrates the slope of the lower sliding surface of the traditional ski as a function of the longitudinal position being considered.
FIG. 9 illustrates the variation in slope of the lower sliding surface of the traditional ski as a function of the longitudinal position being considered.
Figure 10:
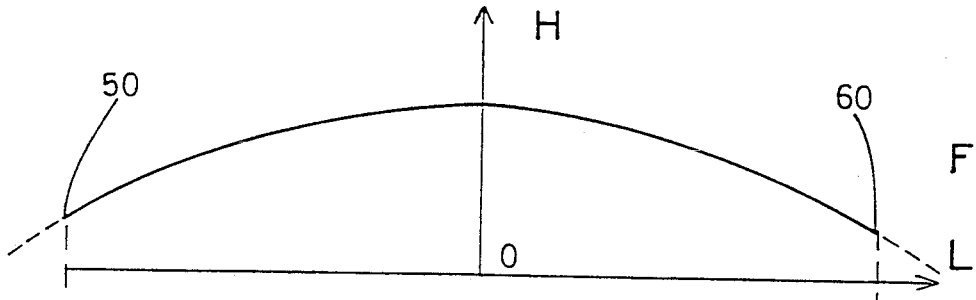
FIGS. 10–12 illustrate the same curves as FIGS. 7–9, for a ski according to the invention.
Figure 11:
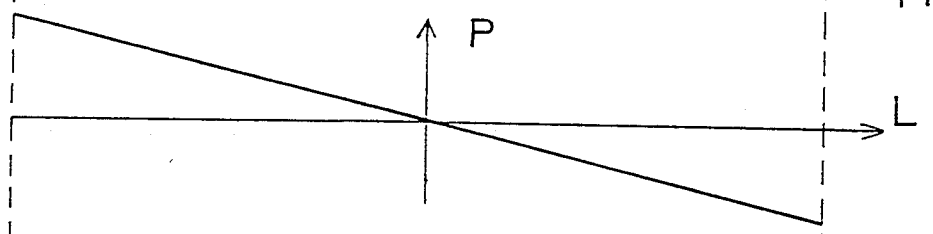
Figure 12:
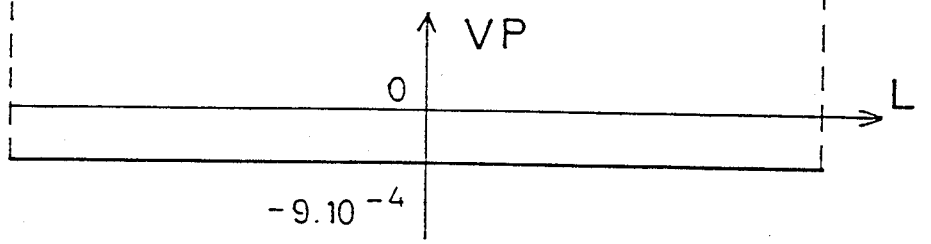

The differences in slight bend between a ski according to the present invention and a traditional cross-country ski are better explained in FIGS. 7–12 which make it possible to characterize the profiles of skis between the front inflexion line 50 and the rear inflexion line 60. These FIGURES illustrate, as a function of the longitudinal position being considered along the length of the ski, the different amounts which can characterized the slight bend. In FIGS. 7 and 10, the height H has been shown, or the distance separating the lower surface of the ski from plane 4 on which the ski rests. In a traditional ski, in FIG. 7, the central zone 7 has a relatively pronounced curve while the zones adjacent the ends are relatively planar. On the other hand, with a ski according to the invention, in FIG. 10, the variation in slope is substantially distributed over the entire length of the central portion 1 of the ski and the profile of the central portion 1 appears as a parabola.

Likewise, in FIG. 8, for a conventional cross-country ski, the slope P of the lower surface of the ski, or first derivative of the height H, has a relatively constant positive value in the zone A or front zone of the ski, then a rapidly decreasing value in the central zone B corresponding to the central zone 7 of the ski, then a relatively constant negative value in the zone C or rear zone of the ski. On the other hand, in FIG. 11, a ski according to the present invention has a regularly decreasing slope P over the entire length of the central portion 1 of the ski positioned between the flexion lines 50 and 60.

In FIG. 9, in a traditional cross-country ski, there has been shown a variation of slope VP, or a second derivative of the height H. In the front zone A, this value is negative and small; in the central zone B, this value is strongly negative, and of traditional modules on the order of $10^{-3}$ to $2.10^{-3}$ $cm^{-1}$ In the rear zone C, this value is slightly negative and constant. On the other hand, in FIG. 12, for a ski according to the invention, this value VP and slightly negative, and of modules of about $9.10^{-4}$ $cm^{-1}$.

In the slightly bent central portion 1, the maximum variation of slope VP has a modules preferably equal to about $6.10^{-4}$ $cm^{-1}$.

In the zone of the central portion 1 positioned adjacent to the front contact line 5, a ski according to the present invention is relatively rigid with respect to the rigidity that a traditional cross-country ski has in the same zone. This rigidity can be obtained by any means known in the state of the art, for example, by providing, in the internal structure of the ski, reinforcement element such as plates of rigid material of appropriate thickness. The measure of rigidity obtained can be achieved by a test such as that shown in FIG. 15. A length L1 of ski of about 570 mm., beginning at the front contact line 5, is retained at its two ends by three supports 9 and 10, while its center is subjected to a force 11 which is substantially perpendicular and of an intensity of 200 newtons. The central zone of this portion of the ski is positioned between two free supports 9 and 10 displaces elastically by a distance D1. The front contact line 5 is generally measured by introducing a cubic wedge 20 of 1 $cm^3$ under the spatula and corresponds to a point at a distance of 9.5 cm. from the center of the wedge towards the middle of the ski. This theoretical determination is necessary to obtain a good reproduceability of the measurements. According to the invention, this distance of displacement D1 must be less than about 200 tenths of mm., i.e., 20 millimeters. By comparison, a conventional cross-country ski, subjected to the same test, has a substantially greater deformation, the distance D1 being generally between about 200 to 350 tenths of mm., i.e, 20 to 35 millimeters.

Likewise, the rear zone of a cross-country ski according to the present invention has a relatively high rigidity with respect to that presented by a traditional cross-country ski. This rigidity can be obtained by any means such as the presence of an internal rigid reinforcement plate of the ski, these means being within the ability of one of ordinary skilled in the art. The rigidity can be measured by a test shown in FIG. 16, similar to the test of FIG. 15, in which the rear zone of the ski positioned over a length L2 of 570 mm. from the rear contact line 6 of the ski, rests on two free supports 12 and 13, its center being subjected to a force 14 which is substantially perpendicular and having an intensity of 200 newtons. The rear contact line 6 is, in a general manner, measured at 5 cm. from the rear end of the ski. According to the invention, the rigidity is such that, under the action of this force 14, the central zone portion of the ski positioned between the two free supports 12 and 13 displaces elastically by a distance D2 which must be less than about 100 tenths of mm., i.e., less than about 10 millimeters. This rigidity is substantially greater than that of traditional cross-country skis, which, subjected to the same test, have displacements D2 between 100 and 250 tenths of mm., i.e., (between 10 and 25 millimeters) and generally, between 150 and 250 tenths of mm (between 15 and 25 millimeters).

Figure 5:
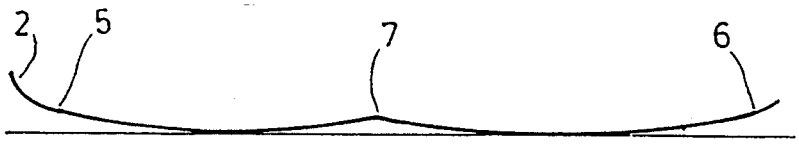
PRIOR ART Fig. 5
FIG. 5 illustrated the profile of a traditional ski when it is resting on an edge, for pushing off in a skating step.
Figure 6:
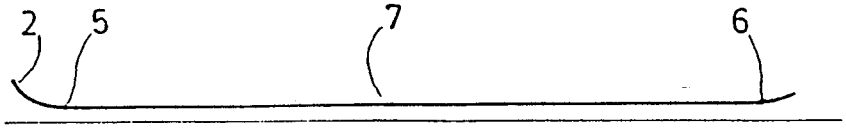
FIG. 6 illustrated the profile of a ski according to the invention when it is likewise in impulse on the edge for a skating step.

The effect obtained by this rigidity, combined with the absence of an elbow in the central zone 7, is a very substantial improvement of the qualities of gripping and sliding on the edge. FIGS. 5 and 6 illustrate partially this effect: In FIG. 5, a traditional ski subjected to a gripping pressure assumes a curved profile at its two ends while its central zone remains bent. On the other hand, in FIG. 6, with a ski according to the present invention, in the presence of a pressure applied to an edge, the ski has a substantial rectilinear profile, distributing the force over a maximum length of the ski. It will be understood easily that a ski according to the invention has substantially better qualities of sliding on edges, as a result of its substantially rectilinear shape.

Figure 15:
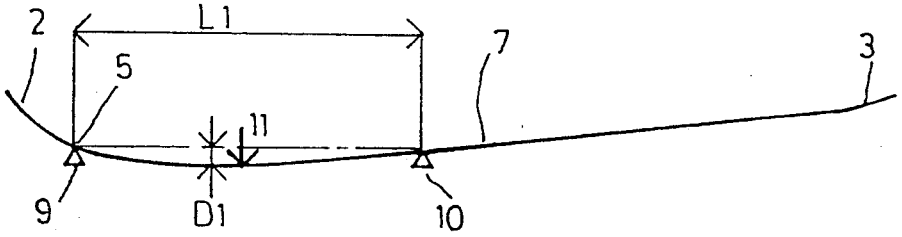
FIG. 15 illustrates the flexibility test to determine the flexibility of the front portion of the ski.
Figure 16:
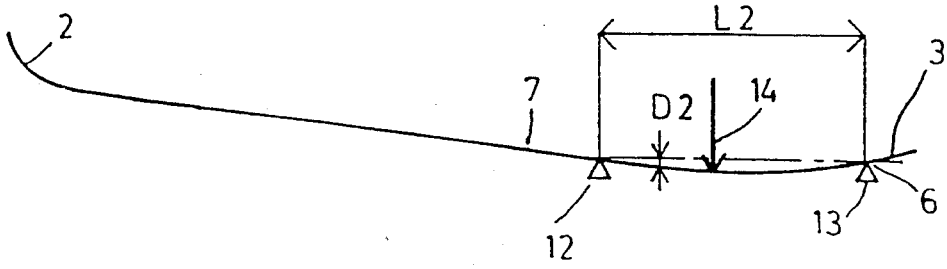
FIG. 16 illustrates the flexibility test to determine the flexibility of the rear portion of the ski.

Good results are obtained by providing, in the front zone of the ski, a rigidity such that the displacement D1 is about 150 tenths of mm., (i.e., about 15 millimeters), during the conditions of the test of FIG. 15. Likewise, good results are obtained when a ski according to the invention has a rigidity of the rear zone such that the displacement D2, in the conditions of the test of FIG. 16 is of about 90 tenths of mm., (i.e., about 9 millimeters).

Figure 13:
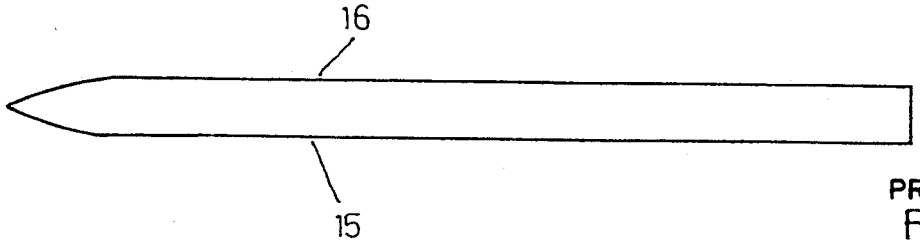
PRIOR ART Fig.13
FIG. 13 is a top view of a traditional cross-country ski.
Figure 14:
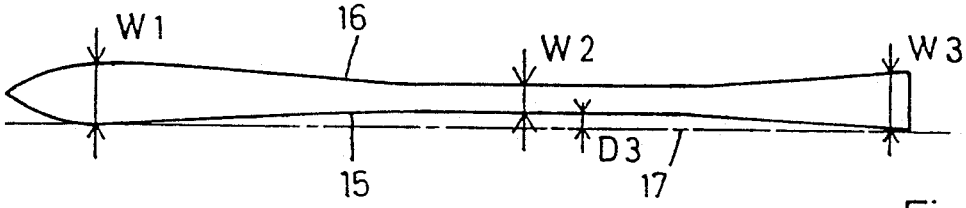
FIG. 14 is a top view of a ski according to the invention.

One can improve the gripping qualities on the edge, to provide a good skating step, by hollowing out the lateral surfaces of the ski, or at least the lateral surface which is interior or the lateral surface which faces the other ski. This characteristic is illustrated in FIG. 13 and 14: FIG. 13 illustrates a traditional cross-country ski having two lateral surfaces 15 and 16 which are substantially parallel with respect to one another. Otherwise stated, the width of the central portion is very close to the width at the front portion of the ski and of the width at the rear portion of the ski.

On the other hand, in FIG. 14, a ski according to the present invention preferably has hollowed out lateral surfaces. For example, when considering that the lateral surface 15 is the interior surface, which faces the other ski not shown in the FIGURE, the maximum distance D3 between the lateral surface 15 and the chord 17 connecting the end zones of the lateral surface 15 is, according to the invention, greater than approximately 1.25 mm. This maximum distance D3 is preferably about 2.5 mm. This distance remains compatible with the standardized shapes of a traditional cross-country ski.

Such a hollowed surface 15 according to the invention can be achieved either on an unsymmetrical ski, i.e., a ski whose surfaces 15 and 16 have different shapes, or on a symmetrical ski in which the surfaces 15 and 16 are symmetrical with respect to the longitudinal median plane of the ski.

For example, in FIG. 14, a symmetrical ski has been shown in this case, one can likewise characterize the lateral hollowed out surfaces by the difference in widths of the ski: the difference between the width W1 of the ski at the front end and the width W2 of the ski in the central zone is greater than about 3 mm. Likewise, the difference between the width W3 in the rear zone of the ski and width W2 in the central zone of the ski is greater than about 2 mm. Good results are obtained by providing a difference in width W1 and W2 which is equal to about 6 mm., and a difference between the widths W3 and W2 equal to about 4 mm.

For example, such a ski can have a central zone whose width W2 is about 43 mm., a front end zone whose width W1 is about 48 mm., and a rear end zone whose width W3 is about 46 mm.

The instant application claims the priority of French Application 90 01311 filed Jan. 29, 1990, the disclosure of which is hereby inseparated by reference thereto.

Finally, although the invention has been described with reference to particular means, materials and embodiments, the invention is not limited to the particulars disclosed and extends to all equivalents in the scope of the claims.

What is claimed is:

1. A cross-country ski comprising:

a lower sliding surface;

a front end zone extending rearwardly from a front end to a front contact line;

a rear end zone extending forwardly from a rear end to a rear contact line;

a front inflexion line rearward of the front contact line and a rear inflexion line forward of the rear contact line;

a central portion extending between the front inflexion line and rear inflexion line, the entire central portion having a generally parabolic profile in side elevation, a constantly decreasing slop of the lower sliding surface with respect to a horizontal plane as a function of distance along the central portion and a constant modulus of variation of slope of less than about $9 - 10^{-4}$ cm $^{-1}$ when the ski is at a non-use rest position.

2. The cross-country ski as defined by claim 1, wherein in the zone of the central portion positioned adjacent to the front contact line, the ski is relatively rigid, having a rigidity such that, when a length of 570 millimeters of the ski, beginning from the front contact line and extending rearwardly, is retained at ends of said length by free supports, is subjected as a center of said length to a substantially perpendicular force of 200 newtons, the elastic displacement of the central zone of said length is less than about 20 millimeters.

3. The cross-country ski as defined by claim 2, wherein in the zone of the central portion positioned adjacent to the rear contact line, the ski is relatively rigid, having a rigidity such that, when a length of 570 millimeters of the ski, beginning from the rear contact line and extending forwardly, is retained at ends of said length by free supports, is subjected at a center of said length to a substantially perpendicular force of 200 newtons, the elastic displacement of the central zone of said length is less than about 10 millimeters.

4. The cross-country ski as defined by claim 2, wherein the elastic displacement of the front portion of the central zone is about 15 millimeters.

5. The cross-country ski as defined by claim 3, wherein the elastic displacement of the rear portion of the central zone is approximately 9 millimeters.

6. The cross-country ski as defined by claim 4, wherein the elastic displacement of the rear portion of the central zone is approximately 9 millimeters.

7. The cross-country ski as defined by claim 1, wherein in the central zone of the slightly bent central portion, the maximum modulus of variation of slope is about $6 \cdot 10^{-4}$ cm$^{-1}$.

8. The cross-country ski as defined by claim 1, further comprising a lateral interior hollowed surface such that the maximum distance between the lateral surface and a chord connecting the end zones of the lateral surface is greater than about 1.25 millimeters.

9. The cross-country ski as defined by claim 8, wherein the maximum distance is about 2.5 millimeters.

10. The cross-country ski as defined by claim 8, wherein the ski is substantially symmetrical, the difference between the width of the ski in the front end zone and the width in the central zone of the ski is greater than about 3 millimeters, and the difference between the width of the ski in the rear end zone and the width in the central zone of the ski is greater than about 2 millimeters.

11. The cross-country ski as defined by claim 9, wherein the ski is substantially symmetrical, the difference between the width of the ski in the front end zone and the width in the central zone of the ski is greater than about 3 millimeters, and the difference between the width of the ski in the rear end zone and the width in the central zone of the ski is greater than about 2 millimeters.

12. The cross-country ski as defined by claim 10, wherein the difference between the widths in the front zone of the ski and in the central zone of the ski is approximately 6 millimeters, while the difference between the widths in the rear zone of the ski and the central zone of the ski is about 4 millimeters.

13. The cross-country ski as defined by claim 11, wherein the difference between the widths in the front zone of the ski and in the central zone of the ski is about 6 millimeters, while the difference between the widths in the rear zone of the ski and the central zone of the ski is about 4 millimeters.

14. The cross-country ski as defined by claim 12, wherein:

the central zone of the ski as a width of approximately 43 millimeters;

the front end zone of the ski has a width of approximately 48 millimeters; and the rear end zone of the ski has a width of approximately 46 millimeters.

15. The cross-country ski as defined by claim 13, wherein:

the central zone of the ski has a width of approximately 43 millimeters;

the front end zone of the ski has a width of approximately 48 millimeters; and the rear end zone of the ski has a width of approximately 46 millimeters.

16. The cross-country ski as defined by claim 1, wherein the ski has a rigidity defined by a displacement of less than about 20 millimeters of a forward length of the ski when a center portion of the forward length of the ski is subjected to a substantially perpendicular force of 200 newtons, the forward length being defined between a front contact line and 570 millimeters rearward of the front contact line.

17. The cross-country ski as defined by claim 16, wherein the ski has a rigidity defined by a displacement of less than about 10 millimeters of a rearward length of the ski when a center portion of the rearward length of the ski is subjected to a substantially perpendicular force of 200 newtons, the rearward length being defined between a rear contact line and 570 millimeters forward of the rear contact line.

18. The cross-country ski as defined by claim 17, wherein the ski has a width in the central portion that is less than a maximum rear width in the rear zone and a maximum front width in the front zone.

19. The cross-country ski as defined by claim 18, wherein the central zone of the ski has a width of approximately 43 millimeters, the front end zone of the ski has a width of approximately 48 millimeters, and the rear end zone of the ski has a width of approximately 46 millimeters.

20. A cross-country ski comprising:

a front contact line and a rear contact line;

a central portion between the front contact line and the rear contact line;

a front end zone, forward of the front contact line, curved upwardly in the form of a spatula;

a rear end zone, rearward of the rear contact line, curved upwardly in the form of a heal;

a central zone of the central portion, the central portion having a modulus of variation of slop of less than about $9 \cdot 10^{-1}$ when the ski is at rest, the rate of change of the slope per unit of distance along the central zone being constant; and a forward length of the ski, said forward length of the ski defined as being located between the front contact line and 570 millimeters rearward of the front contact line, wherein:

said cross-country ski further comprises an outer periphery and an internal structure within the outer periphery, said internal structure including at least one reinforcement element along the forward length of the ski, and wherein:

said at least one reinforcement element has a predetermined dimension to provide the ski with a predetermined rigidity in the forward length of the ski, said predetermined rigidity being defined by a displacement of less than about 20 millimeters of the forward length of the ski when a center portion of the forward length of the ski is subjected to a substantially perpendicular force of 200 newtons.

21. The cross-country ski as defined by claim 20, further comprising a rearward length of the ski, said rearward length of the ski defined as being located between the rear contact line and 570 millimeters forward of the rear contact line, wherein:

at least one of said at least one reinforcement element is located along the rearward length of the ski, and wherein:

said at least of said at least one reinforcement element has a predetermined dimension to provide the ski with a predetermined rigidity in the rearward length of the ski, said predetermined rigidity in the rearward length of the ski being defined by a displacement of less than about 10 millimeters of the rearward length of the ski when a center portion of the rearward length of the ski is subjected to a substantially perpendicular force of 200 newtons.

22. A cross-country ski comprising:

a front contact line and a rear contact line;

an arcuate central portion between the front contact line and the rear contact line;

a front end zone, forward of the front contact line;

a rear end zone, rearward of the rear contact line;

a central zone within the arcuate central portion, the central zone having a lower surface with a modulus of variation of slope of less than about $9 \cdot 10^{-4}$ $cm^{-1}$ when the ski is at rest, the slope of the lower surface of the central zone having a rate of change that is constant per unit of distance along the central zone;

a forward portion of the ski located between the front contact line and 570 millimeters rearward of the front contact line; and means for providing the ski with a rigidity of the forward portion, said rigidity being defined by a displacement of less than about 20 millimeters of the forward length when a central portion of the forward portion is subjected to a substantially perpendicular force of 200 newtons.

23. The cross-country ski as defined by claim 22, wherein the ski has a front inflexion line rearward of the front contact line and a rear inflexion line forward of the rear contact line, wherein the length of the central zone of the arcuate central portion is defined by the front inflexion line and said rear inflexion line.

* * * * *